US006829997B1

(12) United States Patent
Hilleman

(10) Patent No.: US 6,829,997 B1
(45) Date of Patent: Dec. 14, 2004

(54) SKELETONIZED SABOT

(76) Inventor: Terry B. Hilleman, 1911 Knollwood Dr., Marshalltown, IA (US) 40158

( * ) Notice: Subject to any disclaimer, the term of this patent is extended or adjusted under 35 U.S.C. 154(b) by 0 days.

(21) Appl. No.: 10/429,991

(22) Filed: May 5, 2003

Related U.S. Application Data

(60) Provisional application No. 60/407,646, filed on Sep. 3, 2002, and provisional application No. 60/377,802, filed on May 6, 2002.

(51) Int. Cl.[7] ..... F42B 14/06

(52) U.S. Cl. ..... 102/522

(58) Field of Search ..... 102/439, 448–451, 102/520–523

(56) References Cited

U.S. PATENT DOCUMENTS

| | | | | | |
|---|---|---|---|---|---|
| 3,598,057 | A | * | 8/1971 | Potter | 102/452 |
| 4,747,191 | A | * | 5/1988 | Montier et al. | 86/52 |
| 4,953,466 | A | * | 9/1990 | von Gerlach | 102/521 |
| H1353 | H | | 9/1994 | Malejko et al. | |
| H1412 | H | | 2/1995 | Kline et al. | |
| 5,473,989 | A | * | 12/1995 | Buc | 102/521 |
| 5,493,974 | A | * | 2/1996 | Bilgeri | 102/522 |
| 6,085,660 | A | | 7/2000 | Campoli et al. | |
| 6,105,506 | A | | 8/2000 | Gangale | |
| H1999 | H | * | 11/2001 | Newill et al. | 102/521 |

FOREIGN PATENT DOCUMENTS

| | | | | |
|---|---|---|---|---|
| DE | DT3021914 | * | 9/1983 | 102/521 |

* cited by examiner

*Primary Examiner*—Jack Keith
*Assistant Examiner*—James S. Bergin
(74) *Attorney, Agent, or Firm*—McKee, Voorhees & Sease, P.L.C.

(57) ABSTRACT

An improved sabot for small arms is discussed. Incorporating the biomechanical internal skeletal features of vertebrates allows improved sabot support, combined with improved sabot flexibility, to improve projectile launching performance. The present invention is comprised of a nearly full caliber plastic sabot with a tapered aluminum disc base, combined with caliber-reducing aluminum petals that form a forward internal skeleton in a plastic sabot; the aluminum ring of petals is inside the cavity of the sabot's ring of plastic petals and encloses a substantially smaller caliber bullet. Upon firing, both front and rear elements upset the sabot into the bore's rifling. In the muzzle loading application, loading is easier and fouling is reduced.

An alternate embodiment's skeleton is comprised of a nearly full caliber tapered metal disc base, attached to two or more nearly full caliber metal longitudinal fins, which enclose a substantially smaller caliber bullet. Upon firing, the metal disc upsets the sabot into the bore's rifling, as does the muzzle-facing soft body, ahead of and alongside of the bullet. This provides fore and aft support. Projectile (bullet) velocity and accuracy are significantly improved over that provided by the plain plastic sabot; firearm recoil is reduced.

3 Claims, 8 Drawing Sheets

SKELETONIZED SABOT

CROSS-REFERENCE TO RELATED APPLICATIONS

This application claims benefit of U.S. Provisional. Patent Application Ser. No. 60/377,802 filed May 6, 2002 and U.S. Provisional Patent Application Ser. No. 60/407,646 filed Sep. 3, 2002.

BACKGROUND OF THE INVENTION

1. Field of the Invention

The present invention relates to saboted projectiles, more particularly to a plastic sabot, or combination of plastic sabots, supported by a metal or ceramic, or rigid plastic skeleton, which encloses a substantially smaller caliber bullet.

2. Problems in the Art

Fairly recent technology, involving encasing a bullet in a plastic sabot, makes it possible to fire a sub-caliber projectile down a large bore behind large powder charge. The decreased mass of the lighter projectile and sabot provides velocities higher than possible for a full caliber bullet fired down a standard bore size. This allows the use of a smaller and lighter bullet (or projectile) with higher sectional density and ballistic coefficient, providing improved downrange performance and enhancing longer range hit possibilities; it also reduces recoil.

This high-tech sabot application is currently used by not only the military, but also by the muzzle loading sport shooters and shotgun slug hunters. Modern large caliber muzzle loading rifles (shooting saboted bullets) and shotguns (shooting saboted slugs) have advanced to the limit of current technology, with muzzle velocities approximately only half way between large full caliber bullet (or slug) velocity and smaller caliber centerfire cartridge rifle velocity, even with muzzleloaders that use smokeless powder.

Modern muzzle loading rifles and shotgun slug shooters are limited by the amount of caliber reduction in the plain plastic sabot. The plain plastic sabot begins to fail as barrel temperature, caliber difference, or velocity is increased. For example, the normal plastic sabot material used in shotgun shot cups (for slug sabots) and low velocity black powder muzzle loading, fails to maintain accuracy when the barrel temperature rises to any degree, due to failure of bullet (slug) support and gas seal problems. The same problem occurs when velocity is increased or when caliber is reduced to any significant level. The plastic deforms under increased launching pressure, compromising bullet support and gas seal as it travels down the barrel. As the thickness of the sabot plastic wall increases, the potential for plastic deformation and bullet yaw increases. Increasing the stiffness of the plastic has limits in practicality and in function. As the rigidity of the plastic petals enclosing the bullet (slug) increases, problems in sabot disengagement have an adverse affect on accuracy, causing unacceptable accuracy dispersion. This is a main reason centerfire rifle cartridges with high velocity sub-caliber saboted rounds failed to gain acceptance, following their introduction.

Modern muzzleloaders can only be successfully reduced about five calibers (e.g. 50 caliber to 45 caliber), without significantly damaging accuracy, at the present intermediate velocities. This results in mediocre sectional densities and ballistic coefficients; that translates to rapid velocity loss as the bullet or slug travels down range. Mediocre velocity quickly degrades to low velocity with rapid bullet drop and inadequate bullet performance. Increasing the mass and sectional density of the bullet only increases bullet drop and recoil; velocity is decreased, along with downrange performance. It does not decrease terminal bullet performance except on the largest game; this does not make it a good deer hunters choice. Shotgun slugs have similar problems; velocities are even necessarily lower with even greater increases in caliber differences in order to maintain what is often marginal accuracy.

The prior art limitation is a combination of very limited support, combined with gas seal inadequacies, both being antagonized by the problem of need for a clean rapid release, presently afforded by the inadequate plain plastic sabot.

Furthermore, the sabot's advantages of improved long-range accuracy and velocity come at the expense of easy loading. Tight fitting sabots have to be hammered down into place above the muzzleloader's powder charge. This is unpopular with the muzzle loading community and there is currently a trend away from the sabot, returning to slightly under full caliber projectile designs reminiscent to those used in the civil war (Miné ball).

There is still a problem with the Miné ball. It is close to full-caliber, the increased mass and decreased sectional density correspondingly cause decreased velocity and decreased downrange performance as well as increased recoil. In addition, the slightly sub-caliber bullet only seals at the base, permitting some yaw or wobble, as the bullet travels down the bore. This adversely affects accuracy. The length of the bullet may be increased to partially overcome this problem; however, this only increase projectile mass even more. The result is further increased recoil and decreased downrange performance.

There are advances in military sabot technology that have addressed the preceding problems to some degree, in the use of armor piercing fin-stabilized discarding sabot ammunition. Typically, they incorporate a brittle shaft rod-type projectile comprised of tungsten or depleted uranium, designed for penetrating armor plate. There are many designs; most are concerned with solid base support and stabilizing the penetrator during launch.

Two designs are most relevant to prior art bullet and sabot discussions. U.S. Patent H001353 by Malejko is a statutory invention, not a patent. It uses a disc away from the base of the sub-caliber projectile, towards the rod-type penetrator nose. This permits a greater amount of propellant in the cartridge, surrounding the rearward projecting sub caliber stabilizing the fins of the sabot. The disc expands to fill full-bore diameter upon firing, forming a gas seal and propelling the saboted projectile down the bore. U.S. Patent H001412 by Kline is also a statutory invention, not a patent. It uses metal stabilizing fins between petals in the plastic sabot, preventing flexing of the rod-type penetrator upon firing, which degrades accuracy.

There is therefore a need to design a sabot that provides sufficient rigidity to prevent bullet flexing in the sabot (eroding accuracy), sufficient flexibility of the sabot to provide a "clean" accuracy-enhancing bullet release, and sufficient bullet solid base and/or forward support that also makes an expandable strong gas seal.

For the muzzle loading community, there is also a need for easier loading of the saboted projectile. It is also desirable to incorporate any means to minimize fouling of powder residue in the barrel between shots, as this increases the difficulty of seating the next projectile on the powder charge.

Features of the Invention

A general feature of the invention is the provision of an improved sabot, which overcomes problems found in the prior art.

A feature of the invention is improved stability in sabot support, which does not have an adverse affect on accuracy of the bullet or slug.

A further feature of the invention is flexible support that permits a clean rapid release of the projectile, so as to permit good accuracy.

An additional feature of the invention is an improved design and function that permits higher velocities for the sabot-supported projectile.

Yet another feature of the invention is the provision of a skeletal framework within the sabot, which provides improved gas seal and support strength, yet does not scar the gun barrel.

Still further feature of the invention is the provision of a flexible plastic soft body portion of the sabot that functions as a stable full-length guide for the projectile down the gun barrel, and yet permits a clean release of the bullet or slug, following exit from the gun barrel.

For further feature of the invention is the possibility of a plastic sabot encased within another plastic sabot, providing a two-stage caliber reduction, with skeletal support.

Another feature is duplicating the easy loading of the Miné ball (in a muzzleloader) using the modifications of the formerly hard-to-load sabot.

Yet still another feature is the self-cleaning action of a gas-check, which minimizes fouling from black powder and other propellants commonly used in muzzleloaders.

These, as well as other features and advantages of the present invention, will become apparent from the following specification and claims.

SUMMARY OF THE INVENTION

The invention is directed to a discardable sabot for transporting a sub-caliber projectile, when fired in a chamber, down and out a gun barrel, whereby it is then released. The sabot may be utilized in a muzzle loading capacity, resting on a powder charge in the firing chamber. The sabot may also be utilized in a shotgun shell cartridge or in a traditional centerfire (brass) rifle or pistol cartridge. Vertebrate biomechanics are used as a pattern for the model. The internal skeleton of fishes, amphibians, reptiles, and mammals does a far better job of supporting (strengthening) larger body mass than any invertebrate exoskeleton. At the same time it affords superior agility and soft body function. Some of these attributes are desirable to overcome prior art limitations of sabot construction and function in projectile support.

The sabot skeleton is integrated into an ordinary plain plastic sabot, reinforcing crucial areas. It is comprised of a nearly full-caliber rear-facing concave metal (or ceramic and/or rigid plastic) disc that supports the base of the sub-caliber projectile (bullet). Upon firing, the disc expands to full-caliber, deforming into the rifled bore's lands and grooves, and acts as a gas seal. This functions much as the Miné ball skirt, at the base of the bullet from the Civil War era, did. It is sufficiently rigid so as to resist further deformation upon firing. The rest of the skeletal support is located inside the plastic sabot's cavity, contributing to lengthwise rigidity. It is a slightly under caliber metal (or ceramic and/or rigid plastic) ring(s), that may or may not be segmented and may or may not be attached to the base disc. The (segmented) ring may be further sectioned at an angle along the longitudinal axis, dividing the skeletal ring into upper and lower halves. This would allow the upper half of the support ring to slip slightly rearward and laterally upon firing. The skeletal ring surrounds the longitudinal sub-caliber bullet (or slug) much as the segmented sabot petals do, forming a rigid ring (circle) around it; in turn, the sabot's plastic petals surround the skeletal ring. The forward skeletal ring sections are designed to upset their surrounding plastic sabot petals into the rifling as they slip past the rear ring sections, in a rearward and lateral direction, when the gun is fired. This duplicates the action of the expanding skirt in the rear portion providing support in the base and frontal area. This effectively doubles the Miné ball type of support, greatly enhancing stability as the sabot travels down the bore. The upset, from slightly under the rifled bore's land diameter, to barrel groove diameter is caused by gas pressure in the barrel from firing, albeit lower in the front of the sabot than it is behind the sabot. The plastic sabot is simply reinforced in the area necessary (while traveling down the barrel) for improved stability. Thin flexible plastic sabot petals are still able to provide a rapid clean release of the bullet upon exit from the barrel. This permits an improved caliber reduction within the sabot. Accuracy in enhanced. Performance downrange is improved. Recoil is lessened.

Two stage sabot systems are possible for even greater caliber reductions. A ring of the stiff skeletal petals could occupy a space between one sabot enclosed within another sabot. The skeletal sabot offers many possibilities and combinations.

An alternate embodiment could support the bullet above a tapered metal disk, with metal fins surrounding the bullet, much as feathers surround the shaft on an arrow. Filling the remaining bulk with hollow plastic sections would reduce weight even further than with the previous embodiments.

Thus the improved skeletal support overcomes the shortcomings of the plain plastic sabot.

DETAILED DESCRIPTION OF THE PREFERRED EMBODIMENT

The present invention will be described as it applies to its preferred embodiment. It is not intended that the present invention be limited to the described embodiment. It is intended that the invention cover all modifications and alternatives, which may be included within the spirit and scope of the invention.

Figure 1:
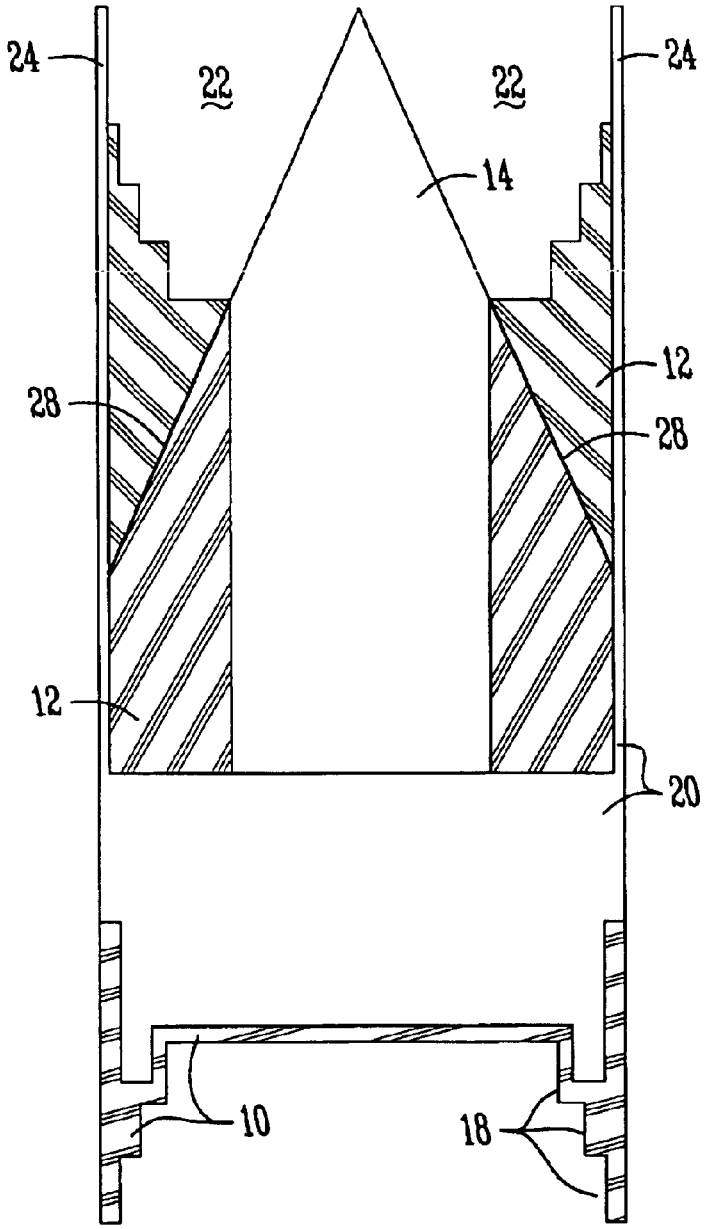
FIG. 1 is a longitudinal cross sectional view of the assembled saboted projectile, according to principles of the invention.
Figure 3:
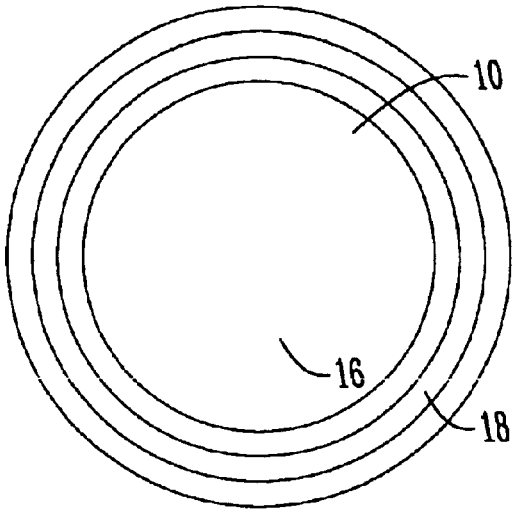
FIG. 3 is a rear aspect view of the skeletal disc.

FIG. 1 shows the rigid skeleton, comprised of a concave front-facing ring of four tapered petals 12 and concave rear-facing rear base portion 10. It is also shows the softer plastic base 20, with the softer plastic petals 24 enclosing the sabot cavity 22. In this preferred embodiment, the rear skeletal base is composed of back-to-back (joined) bowl-shaped aluminum or copper discs 10, slipped over the rear of the relieved plastic sabot 20. The forward part of the disc 10 that encloses this rear portion is the same outside diameter as the rest of the plastic sabot 20. It is held in place by a friction fit; the assembled sabot diameter is nearly the bore (land) diameter of the barrel. The concave rear-facing disc faces the powder charge and, upon firing, the nearly full caliber skirt base 18 slightly expands into the rifled bore's lands and grooves to form a firm gas seal while traveling down the bore length. The concave rear-facing bowl's shelf-like aspect 18 is also illustrated in FIG. 3; this allows propellant gasses to exert lateral pressure and forces the strong but ductile metal framework into the lands and grooves of the barrel, providing a stronger gas seal and minimizing fouling from powder residue. Alternatively, it may be completely concave, without a flattened portion and shelves.

Figure 2:
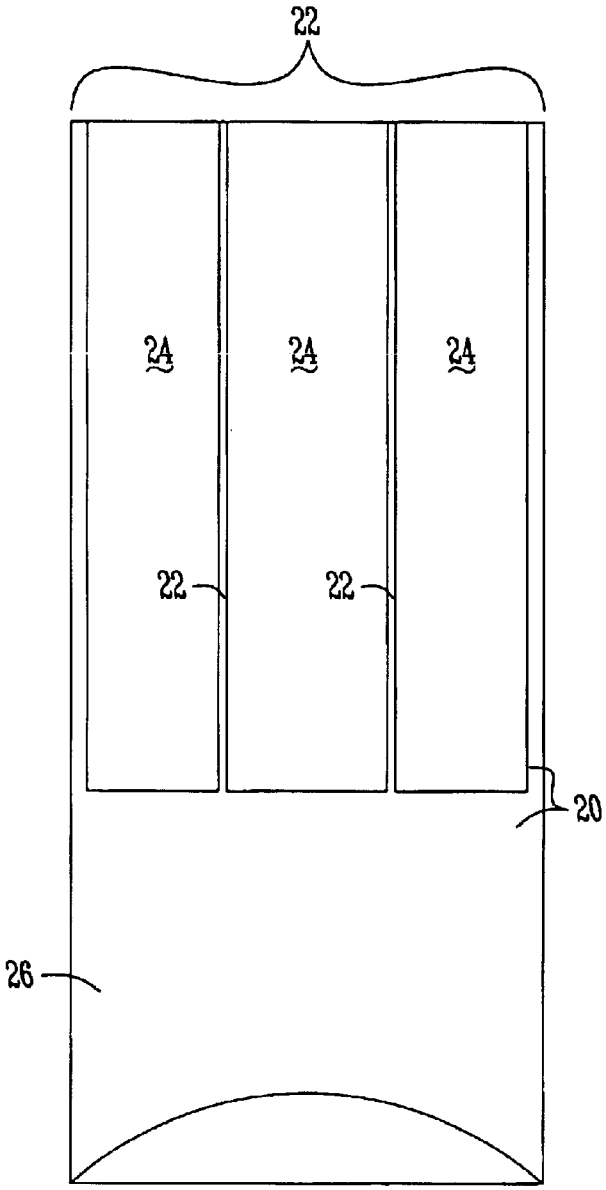
FIG. 2 is a longitudinal view of a plain (ordinary) plastic sabot.

FIG. 2 illustrates an ordinary solid plastic sabot 20 with flexible plastic petals 24 and solid plastic concave base 26. The four plastic petals 24 form the wall of the sabot cavity 22, commonly containing a large caliber bullet with poor aerodynamics. A small amount of relief around the diameter of the rear portion would allow the rear skeletal portion 10 to be easily attached, as in FIG. 1. Other methods of attachment may be utilized.

Figure 11:
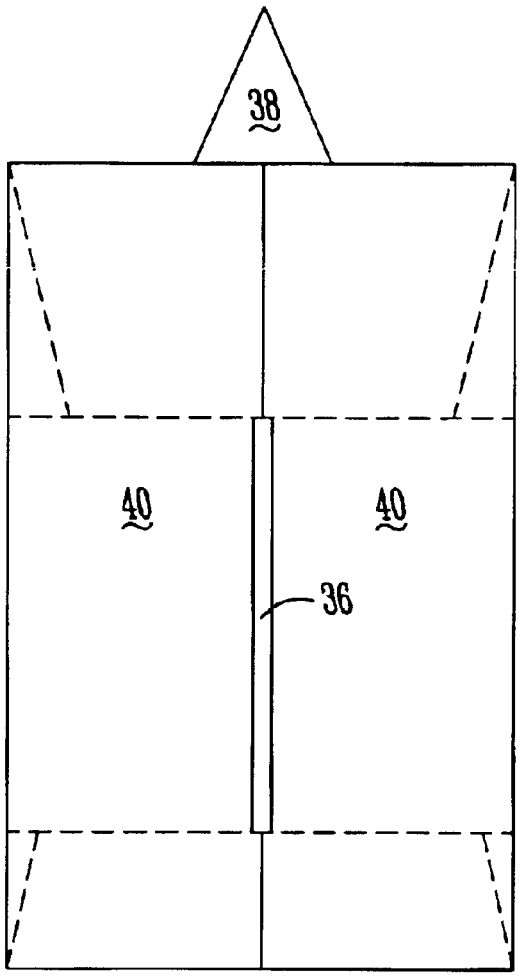
FIG. 11 is an external side view of one embodiment of the present invention.

Five calibers of reduction are near the maximum tolerance for maximum accuracy in the plastic sabot cavity 22 (FIGS. 1, 2 & 4); therefore, further caliber reduction in this preferred embodiment is accomplished by using the ring of caliber-reducing skeletal petals. FIG. 11 is an external side view of one embodiment of the present invention. The ring is comprised of sectioned aluminum (another lightweight material, ceramic or rigid-plastic) petals 12 (FIGS. 1 & 4), located inside of the plastic sabot cavity 22, situated between the bullet (or slug) 14 and the plastic sabot petals 24. The skeletal ring segments 12 may be split into upper and lower halves along the ring's longitudinal axis (28). This would allow the upper half of the ring (12) to slip past the lower half of the ring (12) in a rearward and lateral direction, when the gun is first. That then creates a forward lateral pressure in the projectile, which engages the sub caliber sabot in the rifling. It uses forward increased gas pressure in a manner similar to that used in the base. It provides improved dual stabilization. The skeletal caliber-reducing petals 12 need only extend to cover the bullet bearing area while traveling down the bore, providing lengthwise support of the bullet, preventing yaw. The caliber-reducing petals 12 may or may not be attached to, or incorporated into, the plastic flexible portion of the sabot.

Figure 4:
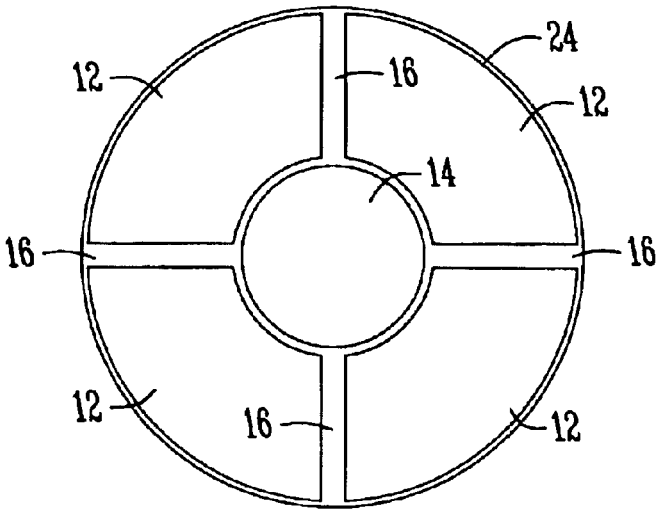
FIG. 4 is a front aspect view of the cup-shaped sabot cavity, with a centered (hollow-point) bullet and our skeletal petals that form a ring around it, surrounded by four thin plastic sabot petals that form the sabot cavity walls.

In FIG. 4 the caliber-reducing petals 12 in this embodiment closely approximate the plastic petals 24 and the bullet (or slug) 14 inside the sabot cavity 22. The spaces 16 between the segmented ring of skeletal petals 12 are exaggerated to illustrate what remains of the sabot cavity 22; the aluminum petal 12 thickness could also be much less. Precise fit aids stability along the entire length of the bearing surface as it travels along the barrel. The frontal aspect of the petals may be cup-shaped concave shelves, much like the rear-concavity of the base in FIGS. 1 and 3. It may be preferable to have these shelves made of soft plastic, separate from the rigid petals in the bullet bearing area. This also allows lateral pressure from compressed gas in the barrel to exert lateral forces and upset the sabot petals 24 into the rifle grooves, much like the rear disc in the concave skeletal base; in this arrangement the bullet is also stabilized from both the front and the rear. FIG. 4 views the cup-shaped concavity (around a bullet 14) formed by the shelves of the skeletal petals; as a further variation, they may be completely concave, without flattened portions.

An alternate embodiment could have two-stage plastic sabots, with one thin-petal plastic sabot enclosed within another thin petal plastic sabot, the two sabots separated by rigid petals of aluminum (or another lightweight metal, or ceramic or rigid plastic) petals. As in the preferred embodiment, they need only extend to cover the bullet bearing area while traveling down the bore, providing lengthwise support of the bullet, preventing yaw. The bowl skeletal base portion could have variable arrangements.

Another alternate embodiment could use the skeletal and soft body principle to reduce projectile weight even further. It offers potential improvement for the centerfire cartridges as well as the shotgun slug.

Figure 5:
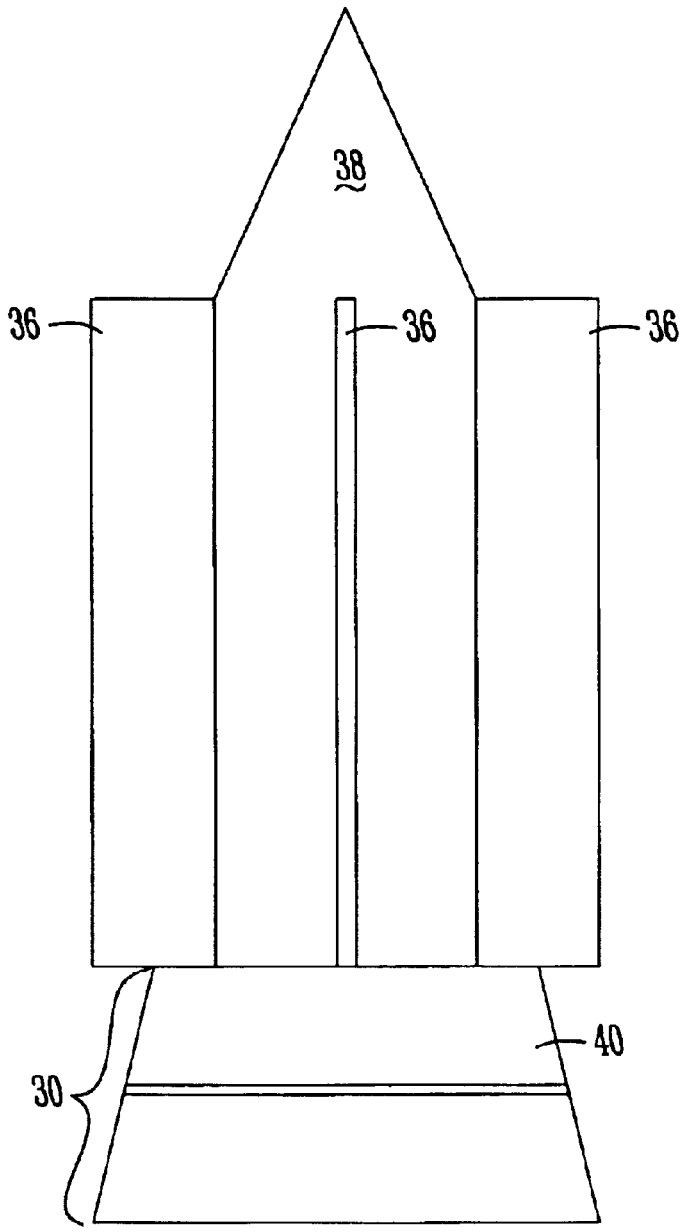
FIG. 5 is an alternative embodiment's longitudinal view of a skeletal framework surrounding a bullet.
Figure 6:
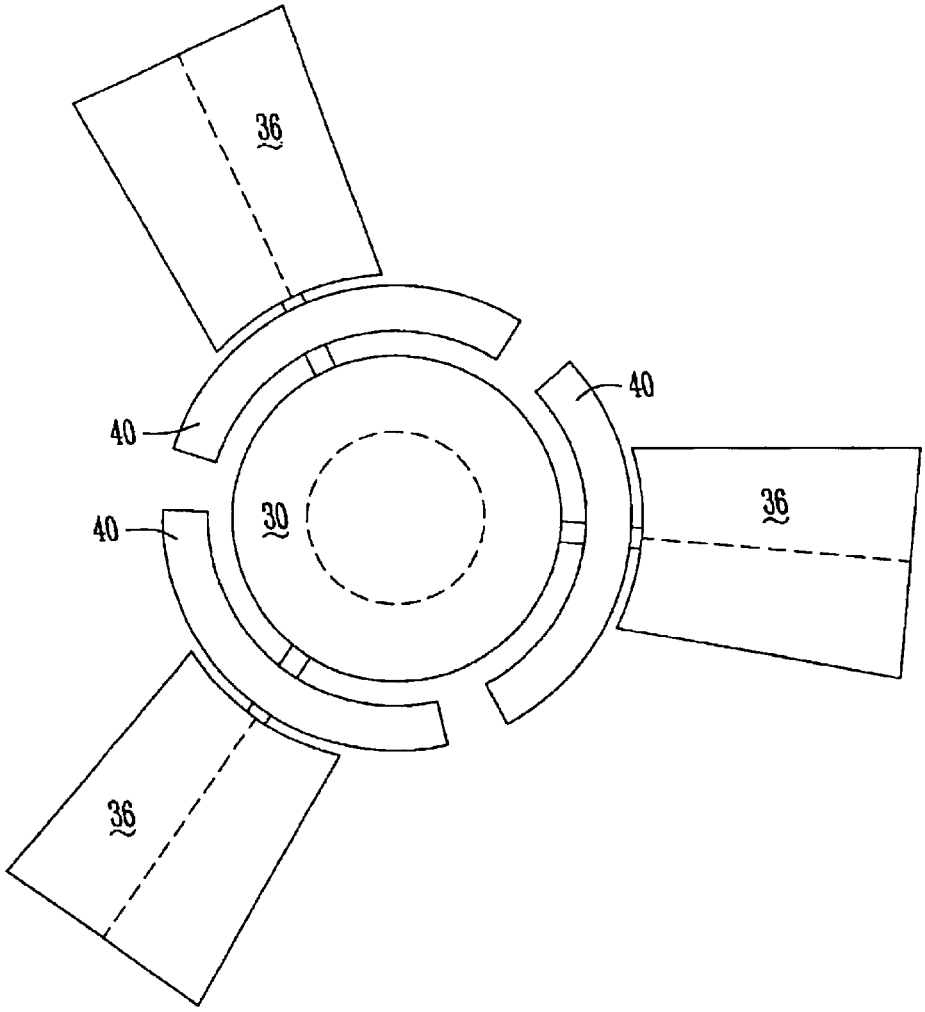
FIG. 6 is a view of an alternate embodiment's skeleton prior to folding into shape.
Figure 7:
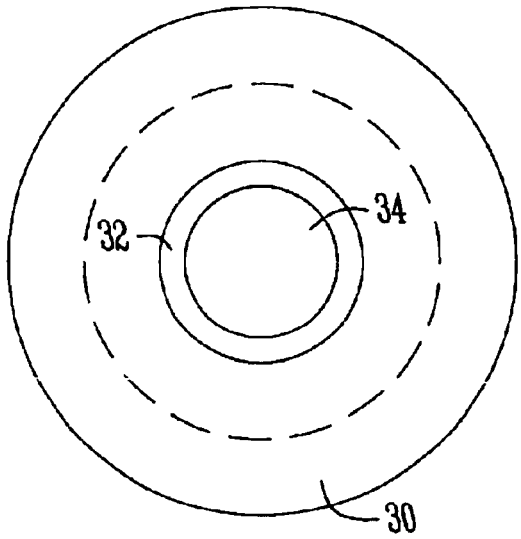
FIG. 7 is a rear aspect view of an alternate embodiment's concave skeletal disc.
Figure 8:
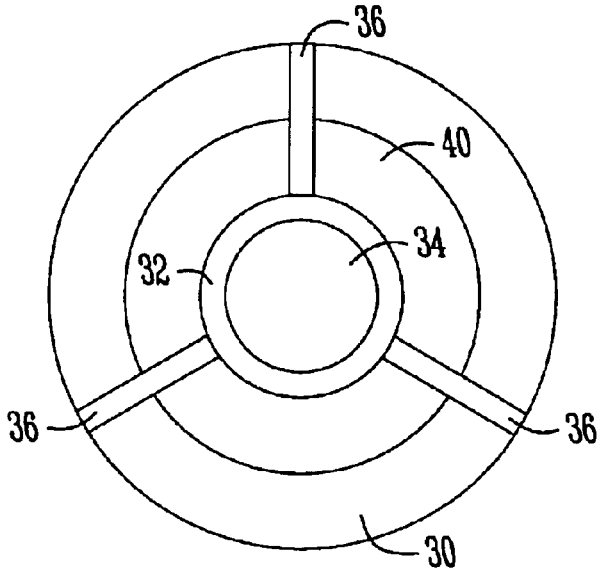
FIG. 8 is a front aspect view of an alternate embodiment's disc and three fins.

In this embodiment, the skeletal component is composed of a bowl-shaped aluminum disc base 30, as illustrated in FIG. 5 and FIG. 7. The concave portion faces the powder charge and, upon fire, the nearly full caliber tapered skirt base slightly expands to form a firm gas seal while traveling down the bore length. The upper half 40 of the tapered base 30 is double thickness for additional support. FIG. 6 illustrates the entire skeleton stamped of sheet metal before it is folded into place. FIG. 7 also illustrates the backside of the flat center portion 32 which may include a circular ridge or depression 34, used to precisely engage and stabilize the rear of the sub caliber projectile (bullet) 38. The convex portion of base 30 faces the open end of the bore as illustrated in FIG. 8. Previously discussed from the concave aspect, the flattened center 32 may have a circular ridge or indentation 34 to precisely engage and stabilize the sub caliber projectile (bullet) from the rear. FIG. 5 and FIG. 8 illustrate the longitudinal aluminum fins 36 extend from the bore diameter to the bullet to the bore diameter of the barrel, traversing over the flat center portion 32 of the base 30 in this embodiment; however, this could be modified in yet another embodiment. The fins 36 can approximate, but not touch the bullet 18; adequate bullet clearance is necessary for a clean release. The fins could number two, three, or more. Yet another embodiment could utilize the additional strength provided by I-beam construction in the longitudinal fins.

Figure 9:
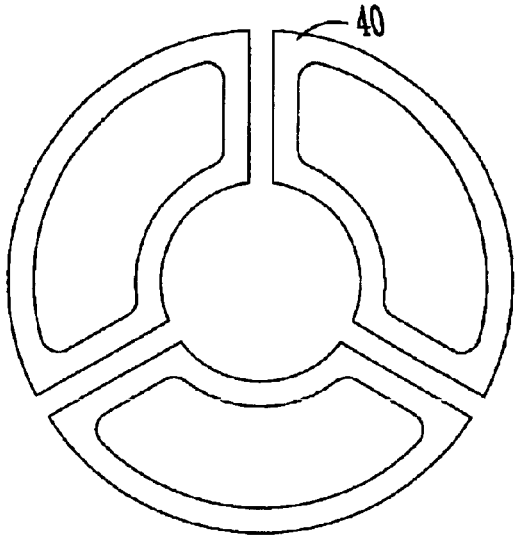
FIG. 9 is a mid-projectile cross sectional view of an alternate embodiment's projectile in the skeletal framework, surrounded by three hollow plastic sabot sections.
Figure 10:
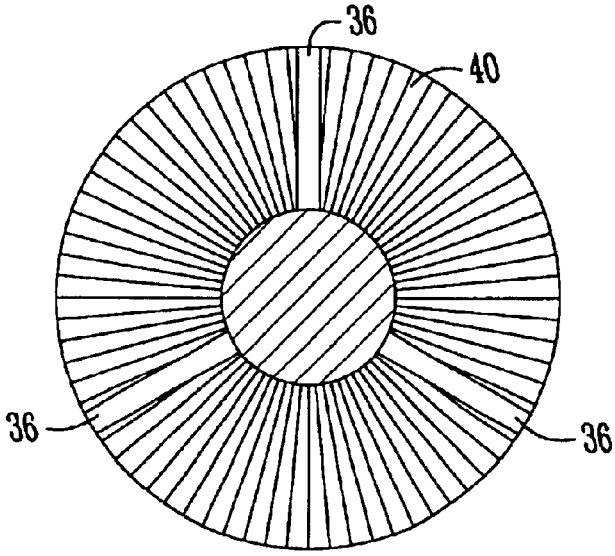
FIG. 10 is a front aspect view of an alternate embodiment's assembled sabot, with cup-shaped front and rear ends.

The soft body portion of the sabot affords the clean bullet release upon exit from the barrel. It also provides lengthwise support of the bullet 38, by preventing yaw through intimate contact with the bullet and the bore. It gains skeletal support from intimate contact with the longitudinal fins 16 and tapered base 30. It complements the base 30 to contribute to a full-length gas seal as the sabot travels down the bore. FIG. 9, FIG. 10 and FIG. 1I illustrate the hollow plastic body sections 40, which rest on base 30 and firmly enclose the bullet 38, intimately supported by longitudinal fins 36. The bore-facing forward ends of the plastic sections 40 are concave, much like the base that is expended by propellant gasses. This upsets the plastic body into the rifled grooves, which improves stability, from the front. This is an addition to the upset from the skeletal disc at the rear.

A general description of the present invention as well as a preferred embodiment and alternate embodiments of the present invention have been set forth above. Those skilled in the art, to which the present invention pertains, will recognize and be able to practice additional variations in the methods and systems described which fall within the teachings of this invention.

Accordingly, all such modifications and additions are deemed to be within the scope of the invention, which is to be limited only by the claims on a subsequent non-provisional application, which references this provisional application.

What is claimed is:

1. A sabot for using smaller caliber bullets in a firearm having a barrel designed for larger caliber bullets, a sabot comprising:

a skeleton having diameter greater than the caliber of the bullet and surrounding the bullet, the skeleton including a plurality of rings wherein the rings include an upper and a lower ring, the upper ring and the lower ring each having a wedge shaped cross section such that when fired, compressed air within the barrel causes the upper ring to move across the lower ring and thereby increase the diameter of the skeleton;

a plurality of plastic petals surrounding the skeleton;

a plastic body having a top and a bottom, the plastic petals secured to the top of the plastic body; and a cup shaped metal base secured to the bottom of the plastic body.

2. The sabot of claim 1 wherein the sabot diameter is smaller than the caliber of the barrel.

3. The sabot of claim 1 wherein the sabot diameter is equal to the caliber of the barrel.

* * * * *